US009846990B2

(12) United States Patent
Gagner et al.

(10) Patent No.: US 9,846,990 B2
(45) Date of Patent: Dec. 19, 2017

(54) VISUALIZING WAGERING GAME ESTABLISHMENT PATRON FLOW

(71) Applicant: WMS Gaming, Inc., Waukegan, IL (US)

(72) Inventors: Mark B. Gagner, West Chicago, IL (US); Vernon W. Hamlin, Lisle, IL (US); Larry J. Pacey, Northbrook, IL (US); Scott H. Schulhof, Chicago, IL (US); Craig J. Sylla, Round Lake, IL (US)

(73) Assignee: BALLY GAMING, INC., Las Vegas, NV (US)

( * ) Notice: Subject to any disclaimer, the term of this patent is extended or adjusted under 35 U.S.C. 154(b) by 139 days.

(21) Appl. No.: 14/846,507

(22) Filed: Sep. 4, 2015

(65) Prior Publication Data

US 2015/0379814 A1 Dec. 31, 2015

Related U.S. Application Data

(63) Continuation of application No. 12/995,940, filed as application No. PCT/US2009/046326 on Jun. 4, 2009, now Pat. No. 9,129,477.

(60) Provisional application No. 61/059,487, filed on Jun. 6, 2008.

(51) Int. Cl.
*A63F 9/24* (2006.01)
*G07F 17/32* (2006.01)

(52) U.S. Cl.
CPC ..... *G07F 17/3239* (2013.01); *G07F 17/32* (2013.01); *G07F 17/3237* (2013.01)

(58) Field of Classification Search
CPC ... G07F 17/32; G07F 17/3237; G07F 17/3239
See application file for complete search history.

(56) References Cited

U.S. PATENT DOCUMENTS

| | | | |
|---|---|---|---|
| 9,129,477 | B2 | 9/2015 | Gagner et al. |
| 2002/0142841 | A1 | 10/2002 | Boushy |
| 2003/0060283 | A1 | 3/2003 | Rowe |
| 2005/0116020 | A1 | 6/2005 | Smolucha et al. |
| 2006/0205489 | A1 | 9/2006 | Carpenter et al. |
| 2007/0087834 | A1 | 4/2007 | Moser et al. |
| 2008/0139305 | A1 | 6/2008 | Vallejo et al. |
| 2008/0268959 | A1 | 10/2008 | Bryson et al. |

(Continued)

FOREIGN PATENT DOCUMENTS

| | | |
|---|---|---|
| WO | 2007097966 | 8/2007 |
| WO | 2009149302 | 12/2009 |

OTHER PUBLICATIONS

"PCT Application No. PCT/US09/46326 International Preliminary Report on Patentability", dated Dec. 16, 2010, 7 pages.

(Continued)

*Primary Examiner* — Damon Pierce
(74) *Attorney, Agent, or Firm* — DeLizio Law, PLLC

(57) ABSTRACT

A patron flow system aggregates wagering game data from a plurality of wagering game machines in a wagering game establishment. The wagering game data indicates a plurality of patrons and times. Patron flow data is generated from the aggregated wagering game data. The patron flow data indicate flows of the plurality of patrons among the plurality of wagering game machines in the wagering game establishment with respect to the times.

19 Claims, 7 Drawing Sheets

(56) References Cited

U.S. PATENT DOCUMENTS

| | | | | |
|---|---|---|---|---|
| 2010/0113161 | A1* | 5/2010 | Walker | G07F 17/32 463/42 |
| 2011/0081961 | A1 | 4/2011 | Gagner et al. | |

OTHER PUBLICATIONS

"PCT Application No. PCT/US09/46326 International Preliminary Report on Patentability", dated Mar. 3, 2011, 11 pages.
"PCT Application No. PCT/US09/46326 International Search Report", dated Jul. 20, 2009, 11 pages.
"U.S. Appl. No. 12/995,940 Final Office Action", dated Aug. 24, 2011, 20 pages.
"U.S. Appl. No. 12/995,940 Office Action", dated Jan. 22, 2015, 23 Pages.
"U.S. Appl. No. 12/995,940 Office Action", dated May 26, 2011, 21 pages.

* cited by examiner

VISUALIZING WAGERING GAME ESTABLISHMENT PATRON FLOW

RELATED APPLICATIONS

This application is a continuation application that claims priority benefit of U.S. application Ser. No. 12/995,940 which is a National Stage application of PCT/US09/46326 filed 4 Jun. 2009, which claims priority benefit of Provisional U.S. Application No. 61/059,487 filed 6 Jun. 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2015, WMS Gaming, Inc.

FIELD

Embodiments of the inventive subject matter relate generally to data processing, and more particularly to generating data that represents flow of patrons through a wagering game establishment.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator.

In addition to the wagering games, the floor layout of a wagering game establishment affects player experience. Floor layout influences traversal across the floor and exposes various non-gaming aspects, as well as gaming aspects, of the wagering game establishment to players, such as restaurants, events, etc.

BRIEF DESCRIPTION OF THE FIGURES

Embodiments of the invention are illustrated in the Figures of the accompanying drawings in which.

DESCRIPTION OF THE EMBODIMENTS

The description that follows includes exemplary systems, methods, techniques, instruction sequences and computer program products that embody techniques of the present inventive subject matter. However, it is understood that the described embodiments may be practiced without these specific details. For instance, although examples refer to flow of patrons, a slightly different perspective could visualize flow of money from players throughout a wagering game establishment. In other instances, well-known instruction instances, protocols, structures and techniques have not been shown in detail in order not to obfuscate the description.

A tool or set of tools can aggregate data over a time period from a variety of different sources within a wagering game establishment to determine player flow or probable player flow through the wagering game establishment. The tool can aggregate data from wireless access points, player account activity, purchases, room access activity based on card keys, RFID interrogators, etc. Some of the aggregated data directly indicates location within the wagering game establishment. The tool processes other data that does not directly indicate location to derive location within the wagering game establishment of the multiple players. The tool synthesizes locations and times to generate player flow data based on the aggregated data, which can indicate actual flow or probable flow. A variety of utilities arise with this player flow data. For instance, a wagering game establishment can use player flow data to evaluate layout of their floor, event schedules, maintenance schedules, strategic placement of advertisements and/or notices, etc. Evaluation of the various aspects of a wagering game establishment with player flow data provides opportunities to target advertisements, to enhance player experience, to enhance revenues, etc.

Figure 1:
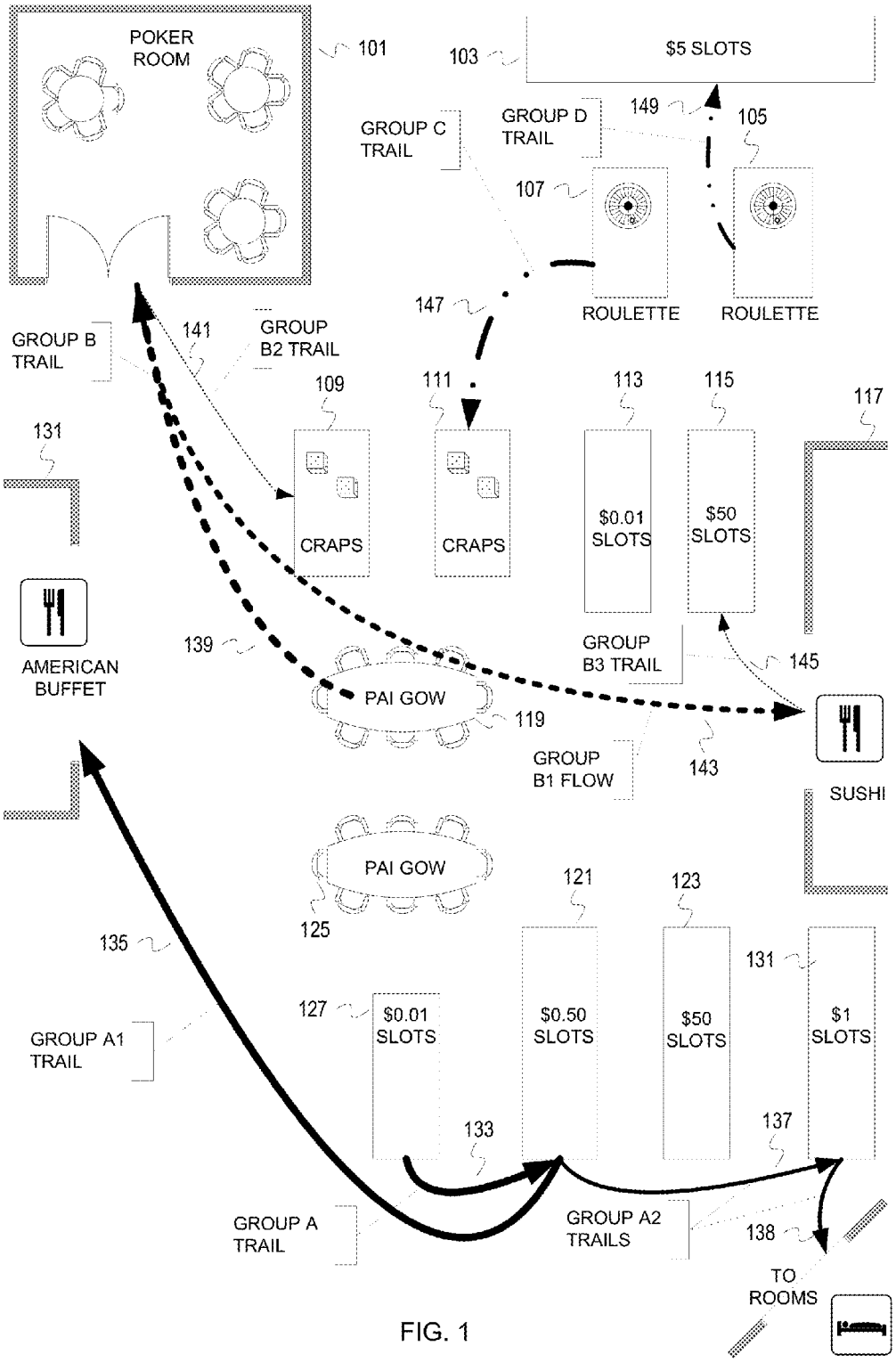
FIG. 1 depicts a conceptual example of visualization of patron flow through a wagering game establishment.

FIG. 1 depicts a conceptual example of patron flow visualization through a wagering game establishment. A wagering game establishment in FIG. 1 includes group games, wagering game machines, and restaurants. The wagering game establishment includes a poker room 101, roulette tables 105 and 107, craps tables 109 and 111, and pai gow tables 119 and 125. The wagering game establishment also includes several banks of slots: a bank of $5 slot machines 103, banks of penny slots 113 and 127, banks of $50 slot machines 115 and 123, a bank of dollar slot machines 131, and a bank of $0.50 slot machines 121. For the restaurants, the wagering game establishment includes an American cuisine buffet style restaurant 131 and a sushi restaurant 117.

Several lines of different lengths and different patterns indicate flows of patrons through the wagering game establishment. Each of the different lines represents a trail of a particular group. A series of one or more trails indicates a flow. Line density represents group size and line pattern represents different root groups. The groups can be defined with different techniques and various criteria. For example, a root group could be a group of tourists registered as a group (i.e., a pre-defined group). As another example, a system generating patron flow data ("patron flow system")

can create an ad-hoc root group and child groups based on criteria (e.g., detecting a threshold number of patrons flowing from a first set of wagering game machines to a second set of wagering game machines within a given time period, detecting transition of patrons to same or different destination locations from a same source location within a given time period, etc.).

Lines 133, 135, 137, and 138 represent trails of a root group A and child groups A1 and A2. The line 133 indicates a trail for a root group A from the bank of penny slots 127 to the bank of $0.50 slots 121. The line 135 represents a trail from the bank of $0.50 slots 121 to the restaurant 131 for a child group A1, which is a substantial portion of the root group A but not all. The lines 137 and 138 represent trails for a child group A2 from the bank of $0.50 slots 123 to the bank of dollar slots 131 and then to their rooms. Although flow for every individual and/or small group could be tracked, child groups that fall below a given threshold and/or outside of a given time period are not tracked in this example.

The flow of groups A, A1, and A2 suggest various characteristics about the group's flocking behavior, which can be used to enhance player experience and revenue for the wagering game establishment. The wagering game establishment can evaluate the flows of group A and the child groups A1 and A2 to perhaps change denomination of the bank 123 from $50 to $1 since the flow indicates all of the members of group A skipped the bank 123. A flow of groups A, A1, and A2 suggests that the larger child group A1 may have played the dollar slots if they encountered a bank of dollar slots instead of the bank 123 of $50 slots. The flow of group A1 also suggests that the revenue may be increased if smaller denomination wagering game machines are located proximate to the restaurant 131.

Lines 139, 141, 143, and 145 represent trails of a root group B and child groups B1, B2, and B3. The line 139 represents a trail for a root group B from the pai gow table 119 to the poker room 101. The line 141 represents a trail for a child group B2 from the poker room 101 to the craps table 109. The line 143 represents a trail for a child group B1 from the poker room 101 to the sushi restaurant 117. The line 145 represents a trail from the sushi restaurant 117 to the bank 115 of $50 slots.

The flows of groups B, B1, B2, and B3 suggest a correlation between patrons that participate in group wagering games and higher denomination wagering game machines. In addition, assuming the sushi restaurant 117 can be categorized as fine dining, the flows for the groups B, B1, B2, and B3 suggest a preference for fine dining over a buffet style restaurant by patrons who play group wagering games and higher denomination wagering game machines. These suggestions by the flows can lead the wagering game establishment to make modifications to their floor layout, such as placing higher denomination wagering game machines near group wagering game tables and changing the denomination of the bank 113 from penny to a higher denomination. In addition, the lack of patron flow with respect to the pai gow table 125 may indicate poor placement of the pai gow table 125.

Lines 147 and 149 represent trails of respective groups C and D. The line 147 represents a flow of group C from the roulette table 107 to the craps table 111. The line 149 represents a flow of group D from the roulette table 105 to the bank 103 of $5 slots.

The single hop flows of groups C and D suggest a tendency to remain at a location for longer periods of time. The single hop flows can suggest more when evaluated with the flows of groups with similar behaviors, such as groups B, B1, B2, and B3. The flow of group C in view of the flow of groups B and B2 reinforce the suggestion that these groups of patrons prefer group wagering games. The suggestion by the flow of group B3 that patrons that participate in group wagering games also prefer higher denomination wagering game machines can be used to motivate the wagering game establishment to increase the denomination of the bank 103.

FIG. 1 only illustrates a few possibilities for visualization of patron flow data. Many different conditions, thresholds, parameters, and filters can be applied to the data that indicates patron flow ("patron flow data") to gain a range of perspectives. For example, patron flow data can be visualized for patrons that spent a minimum amount of money on wagering game machines. As another example, patron flow data can be visualized for wagering game machines near a particular exit for a given time period that corresponds to the end of a performance or show. FIG. 1 also illustrates that patron flow data can be derived from both wagering game data and non-wagering game data.

Figure 2:
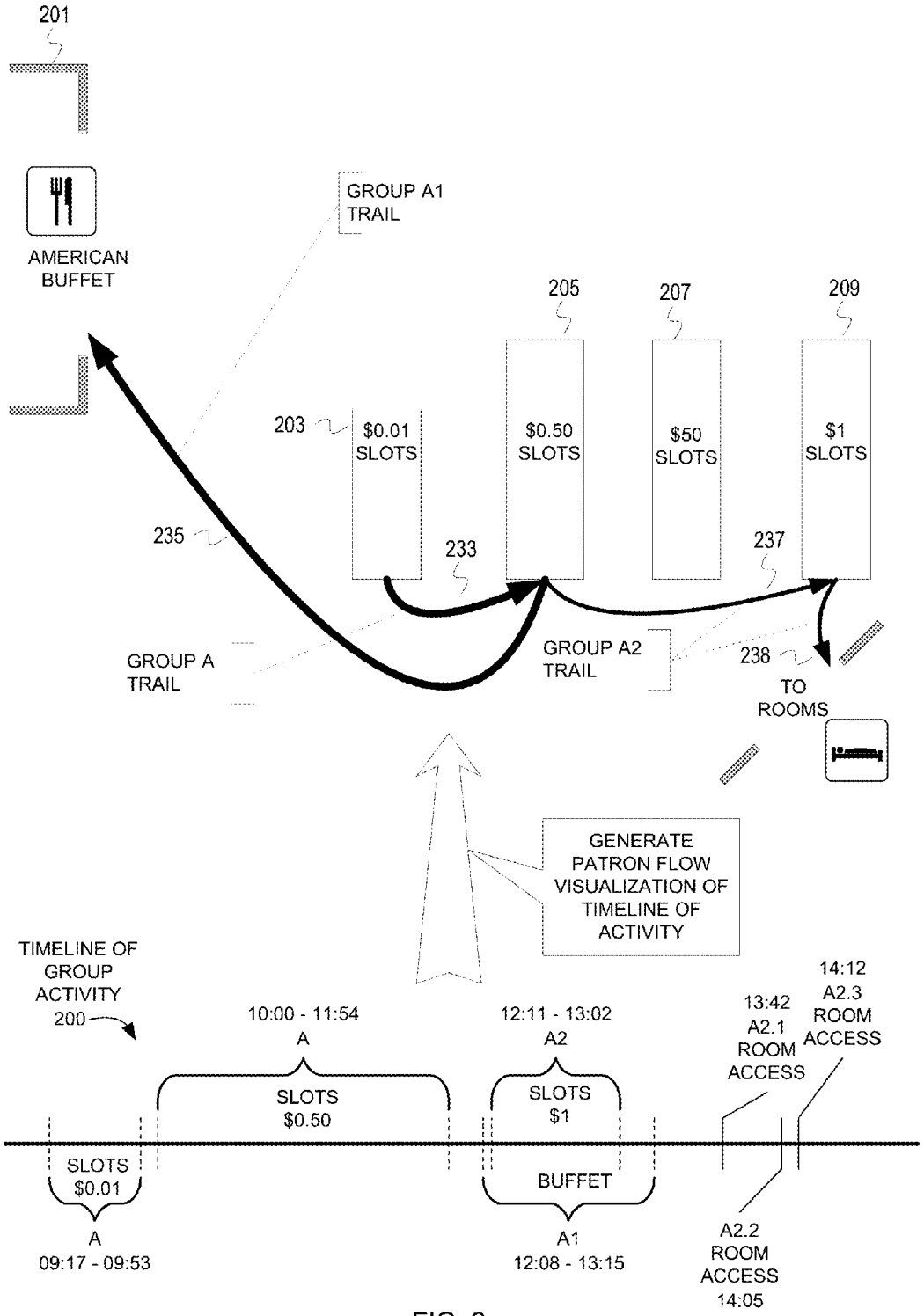
FIG. 2 depicts a conceptual example of generating patron flow visualization based on wagering game data and non-wagering game data and corresponding times.

FIG. 2 depicts a conceptual example of generating patron flow visualization based on wagering game data and non-wagering game data and corresponding times. FIG. 2 depicts a portion of the example wagering game establishment depicted in FIG. 1. FIG. 2 depicts an American cuisine buffet style restaurant 201, and banks of slot machines 203, 205, 207, and 209. FIG. 2 also depicts a timeline 200 of group activity. The patron flow visualization is generated based on the timeline 200.

A series of data points along the timeline 200 are the basis for the trail generated for patron flow visualization. Wagering game machine activity was detected from 9:17 to 9:53 at the bank 203 of penny slots by the patrons that comprise group A. Wagering game machine activity is then detected from 10:00 to 11:54 at the bank 205 of fifty cent slots by the patrons that comprise group A. A line 233 that represents a trail for group A from the bank 203 to the bank 205 is generated from these two data transitions on the timeline 200. Non-wagering game activity (e.g., purchase on a player card, walking by an RFID interrogator in a restaurant, etc.) indicates patrons that comprise group A1 eating (or at least entering and remaining) in the restaurant 201 from 12:08 to 13:15. A line 235 that represents a trail for group A1 from the bank 205 to the restaurant 201 is generated based on this transition on the timeline 200. Data from the timeline 200 indicates wagering game activity detected from 12:11 to 13:02 at the bank 209 of dollar slots by patrons that comprise group A2. A line 237 that represents a trail for group A2 from the bank 205 to the bank 209 is generated based on this data from the timeline 200. Data from the timeline 200 indicates room access at 13:42, 14:05, and 14:12 by respective patrons A2.1, A2.2, and A2.3 from group A2. A line 238 that represents a trail for group A2 from the bank 209 to their rooms is generated based on this room access data illustrated on the timeline 200.

Although FIG. 2 depicts time ranges and banks of wagering game machines, embodiments are not so limited. Patron flow data can be visualized based on a series of points in a time range, disparate points in time aggregated together, blocks of time, etc. In addition, patron flow data can be visualized at different levels of granularity. For example, patron flow data can be visualized for individual wagering game machines instead of or in addition to visualizing patron flow from/to banks of wagering game machines. Furthermore, visualization of patron flow data can be depicted with any of a variety of graphical possibilities.

Simple lines are utilized in the Figures, but patron flow can be visualized with animation, images, etc.

Figure 3:
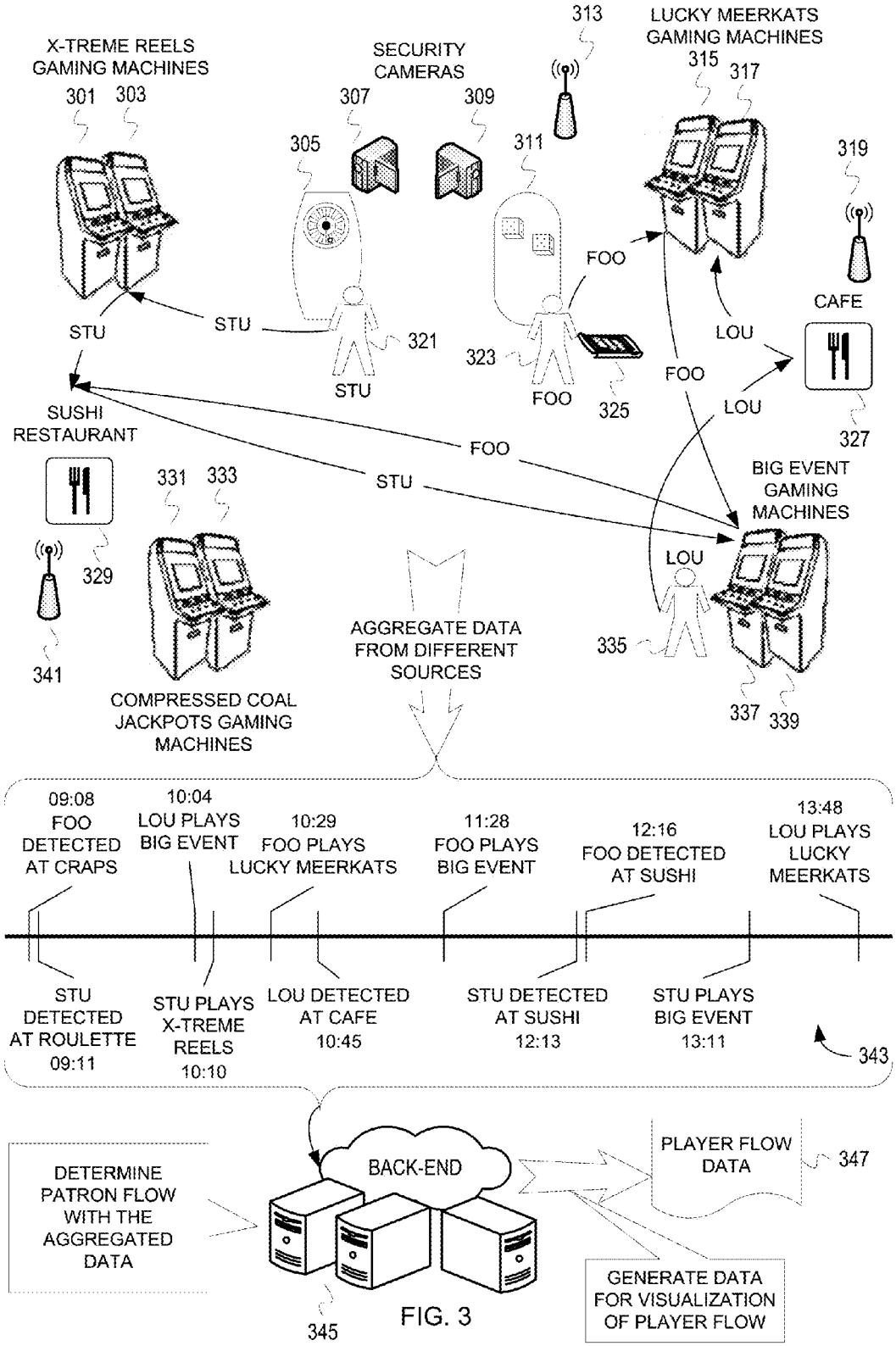
FIG. 3 depicts a conceptual example of aggregating data for patron flow visualization at an individual wagering game machine and individual patron level of granularity.

FIG. 3 depicts a conceptual example of aggregating data for patron flow visualization at an individual wagering game machine and individual patron level of granularity. An example wagering game establishment includes X-Treme Reels gaming machines 301 and 303, Lucky Meerkats gaming machines 315 and 317, Big Event gaming machines 337 and 339, and Compressed Coal Jackpots gaming machines 331 and 333. The example wagering game establishment also includes a roulette table 305, a craps table 311, a sushi restaurant 329, and a café 327.

A timeline 343 illustrates when patron activity is detected based on data aggregated from different sources throughout the wagering game establishment. The different sources include security cameras 307 and 309 near the roulette table 305 and the craps table 311, all of the gaming machines, and wireless access points/RFID interrogators 313, 319, and 341. At 9:08, the security camera 309 captures data used to identify a patron Foo 323 at the craps table 311. The patron Foo 323 also has a portable wagering game machine 325. The wireless access point 313 detects the portable wagering game machine 325 at 9:08 and provides data that indicates presence of Foo near the wireless access point 313, which is near the craps table 311. Data from the security camera 309 and from the wireless access point 313 can collectively be used to ascertain location of Foo 323 at the craps table 311, as redundant data indicating location of Foo 323 at the craps table 311, etc. In addition, the access point data from the portable wagering game machine 325 can be used to identify Foo 323 and be associated with an image of Foo 323 captured by the security camera 309. At 9:11, the security camera 307 captures data used to identify a patron Stu 321 at the roulette table 305. Although not depicted, location of patrons can also be determined with player account activity data generated from use of player cards and/or determined with location data generated from RFID chips embedded in player cards and/or wagering chips. At 10:04, the gaming machine 337 generates data that indicates gaming activity by a patron Lou 335. At 10:10, the wagering game machine 301 generates data that indicates gaming activity by Stu 321. At 10:29, the wagering game machine 315 generates data that indicates gaming activity by Foo 323. At 10:45, the RFID interrogator 319 generates data that indicates Lou 335, assumed to have a player card with an RFID chip for this example, is near the café 327. In addition or alternatively, data from the café 327 (e.g., payment data, reservation data, etc.) indicates and/or confirms presence of Lou 335 in the café 327. At 11:28, the gaming machine 337 generates data that indicates gaming activity by Foo 323. At 12:13 and 12:16, the RFID interrogator 341 generates data that respectively indicates Stu 321 and Foo 323, assumed to have player cards with RFID chips, are near the sushi restaurant 329. In addition or alternatively, data from the sushi restaurant 329 (e.g., payment data, reservation data, etc.) indicates and/or confirms presence of Stu 321 and Foo 323 in the sushi restaurant 329. At 13:11, the gaming machine 337 generates data that indicates gaming activity by Stu 321. At 13:48, the gaming machine 317 generates data that indicates gaming activity by Lou.

A back-end 345 (e.g., one or more servers in communication with databases of the aggregated data) determines patron flow with the data aggregated across these different sources, and generates player flow data 347 used for visualizing the determined patron flow. The back-end 345 determines a flow for Stu 321 from the roulette table 305, to the gaming machine 301, to the sushi restaurant 329, and then to the gaming machine 337. The back-end 345 determines a flow for Foo 323 from the craps table 311, to the gaming machine 315, to the gaming machine 337, and then to the sushi restaurant 329. The back-end 345 also determines a flow for Lou 335 from the gaming machine 337, to the café 327, and then to the gaming machine 317.

From these flows, a tool could flag the Compressed Coal Jackpots gaming machine 331 and 333 as low use since none of the flows involved them. A user or tool could also use the flow visualization of Foo, Stu, and Lou to realize the attractiveness of the Big Event gaming machines 337 and 339.

Figure 4:
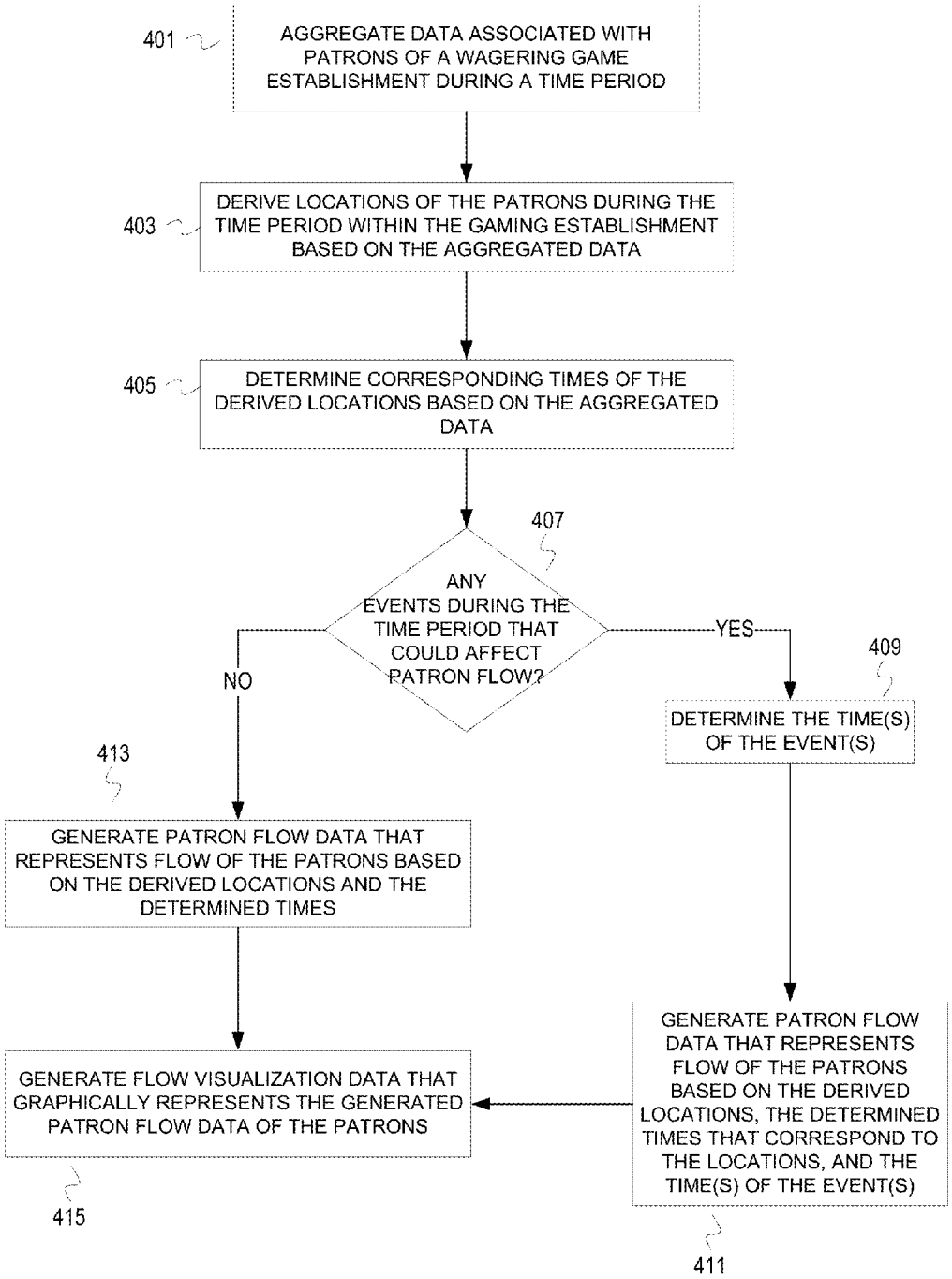
FIG. 4 depicts a flowchart of example operations for generating patron flow visualization data.

FIG. 4 depicts a flowchart of example operations for generating patron flow visualization data. At block 401, data associated with patrons of a wagering game establishment during a time period are aggregated. For example, data from wagering game activity databases and RFID interrogator databases over an eight hour time period are aggregated and chained. At block 403, location of the patrons during the time period within the wagering game establishment are determined based on the aggregated data. For instance, identifiers of individual wagering game machines are mapped to locations within the wagering game establishment. At block 405, times that correspond to the derived locations are determined based on the aggregated data. For instance, time stamps are extracted from wagering game events. At block 407, it is determined if any events during the time period occurred that could affect patron flow. For example, a patron flow system accesses a schedule of performances to determine if a performance began or ended during the time period. If no events are found, then control flows to block 413. If events that could impact patron flow are discovered, then control flows to block 409.

At block 409, the time(s) of the event(s) is determined. At block 411, patron flow data that represents flow of the patrons during the time period based on the derived location, corresponding times, and the time(s) of the event(s) are generated. For example, a patron flow system generates a data structure representation of a graph with edges that correspond to trails and nodes that correspond to locations. Control flows from block 411 to block 415.

If a patron flow impacting event was not discovered at block 407, then patron flow data that represents flow of patrons based on the derived locations and determined times are generated. For example, the patron flow system generates a hash table indexed by patron identifier with each entry indexing into a linked list of nodes that represent trails of the indexing patron. At block 415, flow visualization data that graphically represents the patron flow data are generated. For instance, graphic elements are generated for elements of the patron flow data.

Although examples refer to generating player flow data, such as data structures that represent patron flow, these examples should not be used to limit embodiments or scope of the claims. Embodiment can generate player flow data by tagging entries in databases, cloning portions of databases and reorganizing the cloned portions, copying entries from databases to build a player flow database, etc. Embodiments can construct queries and/or search commands to extract data based on the tagging, for example, that represent player flow.

In addition to evaluating floor layout, targeting advertising, scheduling maintenance, maximizing flow, etc., using patron flow data, wagering game establishments can engineer or infer social groups based on player flow data. Social interaction and larger social groups may enhance patron experience and excite patron activity. Overlapping flows among patrons can indicate similar behavior (e.g., eating times, sleeping times, preferred cuisine, etc.) and similar wagering game preferences (e.g., preferences for high denomination wagering game machine, lower denomination wagering game machine, group wagering games, particular brands of gaming machines, etc.).

Figure 5:
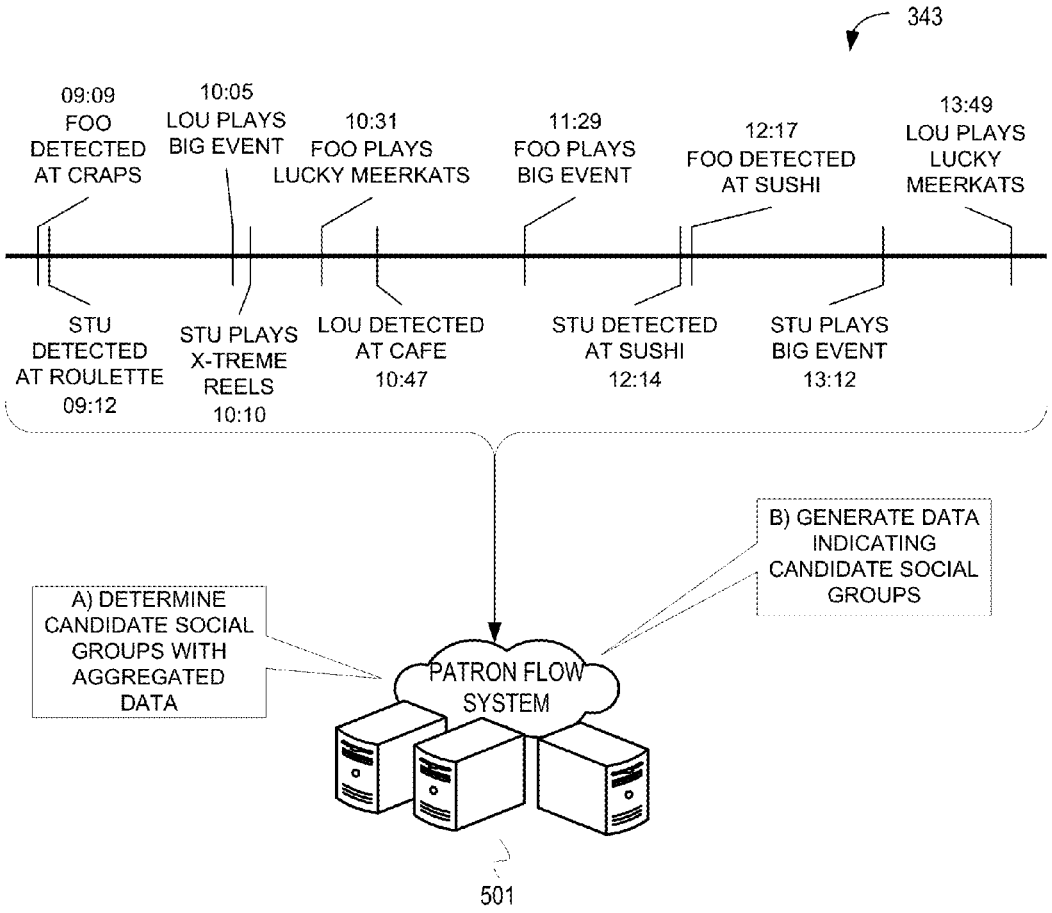
FIG. 5 depicts an example use of patron flow data for suggesting a social group.

FIG. 5 depicts an example use of patron flow data for suggesting a social group. FIG. 5 uses the timeline 343 from FIG. 3. At a stage A, a patron flow system 501 determines a candidate social group with patron flow data. From the patron flow data represented by the timeline 343, the patron flow system 501 can determine a candidate social group should be comprised of Stu and Foo. The flows of Stu and Foo overlap at the group wagering game area early in the morning, and the sushi restaurant within three minutes of each other. The patron flow system 501 may also suggest a candidate social group based on flow intersections indicated in the patron flow data. Although not overlapping, the flows of Foo, Stu, and Lou intersect at the Big Event gaming machines. The patron flow system 501 can suggest a candidate social group based on patrons having degrees of overlap in their flows, a threshold number of intersections in their flows, etc. The patron flow system 501 can go further and suggest social group based on inferences derived from patron flow data. Referring back to FIG. 1, the patron flow system 501 could suggest a candidate social group comprised of the patrons of groups B, C, and D even though their flows do not intersect or overlap. The patron flow system 501 can analyze the patron flow data of these groups and determine that the patrons of these groups share an interest in group wagering games. The patron flow system 501 suggests the social group based on this determination.

Figure 6:
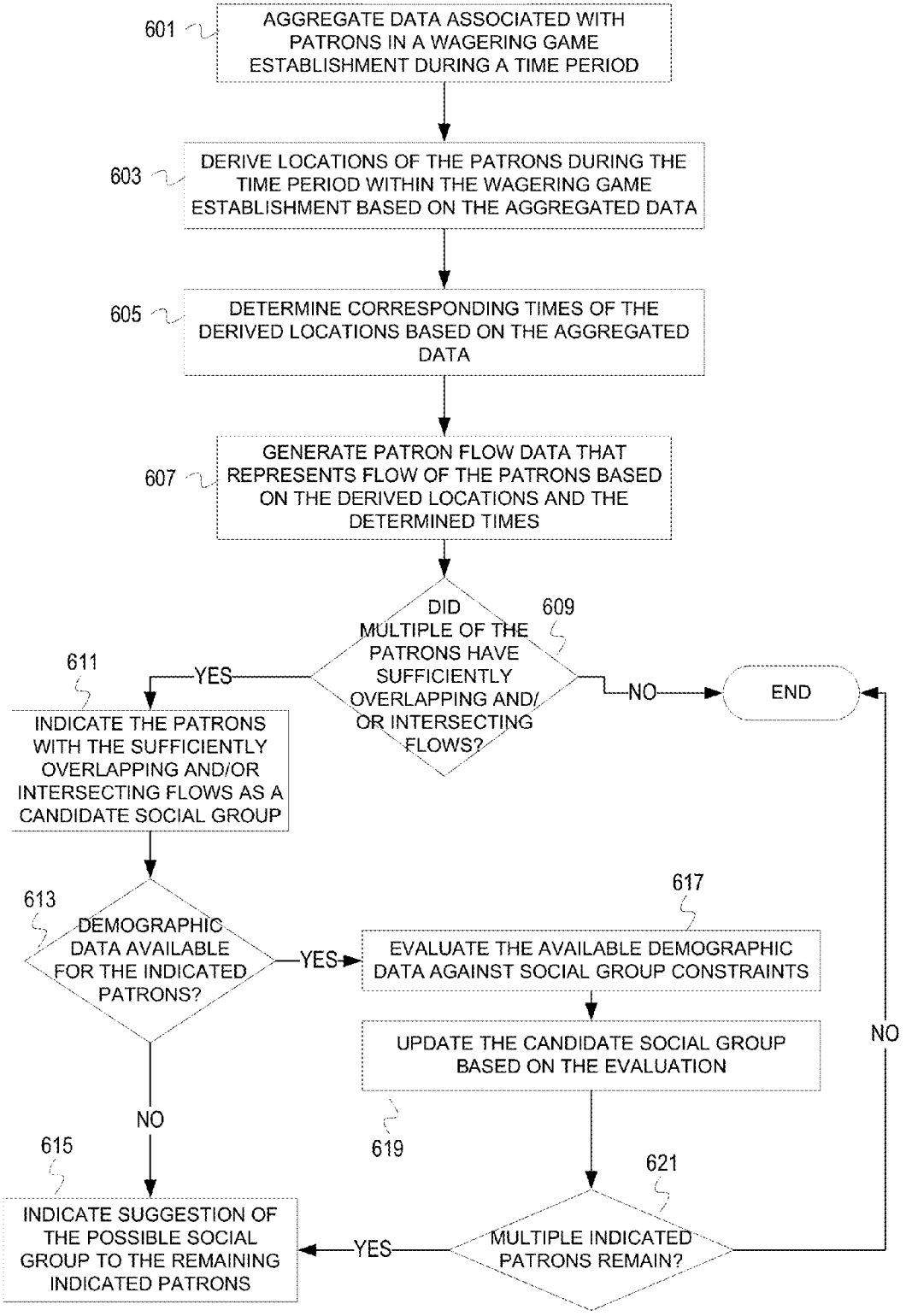
FIG. 6 depicts a flowchart of example operations for suggesting social groups based on patron flow data.

FIG. 6 depicts a flowchart of example operations for suggesting social groups based on patron flow data. At block 601, data associated with patrons of a wagering game establishment during a time period are aggregated. At block 603, location of the patrons during the time period within the wagering game establishment are determined based on the aggregated data. At block 605, times that correspond to the derived locations are determined based on the aggregated data. At block 607, patron flow data that represents flow of the patrons through the wagering game establishment based on the derived locations and the determined times are generated. At block 609, it is determined if multiple of the patrons have sufficiently overlapping and/or intersecting flows. For example, the patron flow system searches for patrons with flows that overlap (e.g., patrons who were at a first bank of wagering game machines during a first time window and moved to a second bank of wagering game machines during a second time window) and/or patrons with at least x flow intersections as indicated by the patron flow data. If multiple patrons are found to have sufficiently overlapping and/or intersecting flows, then control flows to block 611. Otherwise, flow ends.

At block 611, the patrons with the sufficiently overlapping and/or intersecting flows are indicated as a possible social group. For example, account identifiers for the patrons are associated with a candidate social group identifier. At block 613, it is determined if demographic data is available for the indicated patrons. Examples of demographic data include country of origin, residence, age, frequency of patronage, cumulative wagering, etc. If demographic data is available, then control flows to block 617. If demographic data is not available, then control flows to block 615.

At block 617, the available demographic data is evaluated against social group constraints. At block 619, the candidate social group is updated based on the evaluation. For example, social group constraints can indicate limit to age gaps among patrons of a social group. Another social group constraint may indicate that patrons of a social group should speak a common language. For example, if the indicated patrons include 3 patrons who speak Japanese and one patron who does not speak Japanese, then the non-Japanese speaking patron would be removed. At block 621, it is determined if multiple patrons are still indicated for the candidate social group. If not, then the flow ends. If multiple candidates are still indicated, then control flows to block 615.

At block 615, the suggestion of the candidate social group is indicated to the remaining indicated patrons. The suggestion of the candidate social group can be indicated directly or indirectly. For instance, e-mail messages can be sent to the indicated patrons to notify them that other patrons have similar interests. As another example, group events can be orchestrated to place the indicated patrons in proximity (e.g., a special wagering game event only for the indicated patrons) without specifically suggesting the social group.

Although FIG. 6 depicts operations for using patron flow data to engineer a social group, patron flow data can be used to infer a social group. For instance, the operations can be performed to generate a data structure of an inferred social group. Subsequent operations can then be performed to validate the inferred social group instead of suggesting the social group. In addition, whether a social group is engineered or inferred, a wagering game establishment can enhance the experience of the social group with various offers, invitations, information, etc.

A social group inference/engineering system can provide information about an event affecting one of the members of the inferred/engineered social group to the other members. For example, if Foo hits a jackpot then a notification can be sent to the Stu and Lou (assumed to be in an inferred/engineered social group with Foo) (e.g., via text messaging, messaging to wagering games machines being played by Stu and Lou, phone calls, etc.). A system that provides this information about wins can deliver different granularities of information (e.g., a simple message that Foo won, a message that indicates amount of the jackpot and location of Foo, etc.). The system that provides this information can also limit recipients to those who opt-in to the social group inference/engineering system, those who indicate a preference in their player accounts for social interaction, etc.

The social group inference/engineering system can provide invitations to members of an inferred/engineered social group to participate in a social gaming event, such as a communal gaming event or a tournament, and excite their gaming activity. For example, the system can send invitations to Foo, Stu, and Lou to play Big Event together. The system can condition sending the invitation on the profiles of Foo, Stu, and Lou. For instance, the system may not send an invitation to Lou because Lou's profile indicates a preference for card games. As another example, the system can send an invitation to a poker game to the members because Lou's profile indicates a preference for card games. The system can also monitor for occurrences of events that affect at least one of the members to trigger an invitation. They system may detect that Foo and Stu have won several times and then send an invitation to Foo and Stu to participate in a tournament type game.

The social group inference/engineering system can provide offers to members of an inferred/engineered social group to drive use of amenities, distribute marketing information, etc. The system can notify members of a sweepstakes for a group vacation, free spins, meals, etc., and automatically register the members of the inferred/engineered social group if permitted by the members (e.g., based on their profiles, responses to prompts, etc.). The system can send a message to the members for one free appetizer at a restaurant, reduced green fees, etc. The system can use acceptance of the offers to validate an inferred/engineered social group. For example, if Foo and Stu accept the offer then the system can update the structure that represents the social group to validate Foo and Stu as members of the inferred/engineered social group.

They social group inference/engineering system can contact less than all members of a social group with offers, invitations, etc., and motivate the contacted social group subset to involve the other members. For example, the system can send an invitation to Foo for a poker game with an offer of a free steak and/or $20 of chips if Foo brings along 3 friends. The system can generically refer to Foo bringing along friends, suggest that Foo ask Stu and Lou. Embodiments of such a system can also ask an individual is the individual would like the system to recommend some patrons to invite. If the individual accepts, then the system can recommend other patrons based on an engineered/inferred social group, assuming those other patrons are participating in the system.

Utilizing inferred/engineered social groups is not limited to use in isolation. A system can create combinations of offers, invitations, notifications, etc. to enhance the gaming experience, improve consumption of amenities, etc. For example, Foo and Stu can be invited to participate in a slot tournament when the system detects that both have won beyond a given threshold amount along with an offer of two free tickets to a show if one of them wins. The system can also send Foo and Stu an offer of reduced green fees if they persuade Lou to join them in the tournament.

The described operations can be performed by logic not described in the block diagrams. In addition, embodiments can perform operation by executing instructions residing on machine-readable media (e.g., software), while in other embodiments, the operations can be performed by hardware and/or other logic (e.g., firmware). In addition, the operations can be performed in series, while in other embodiments, one or more of the operations can be performed in parallel. Moreover, some embodiments can perform less than all the operations shown in any flow diagram. For example, with reference to FIGS. 4 and 6, operations to derive location are not necessary. Operations can be performed to base patron flow on trails between wagering game machines, for example, without regard to actual physical location within the wagering game establishment. Even though the physical trail may not be visualized, this patron flow among the wagering game machines can still be visualized.

Wagering Game Networks

Figure 7:
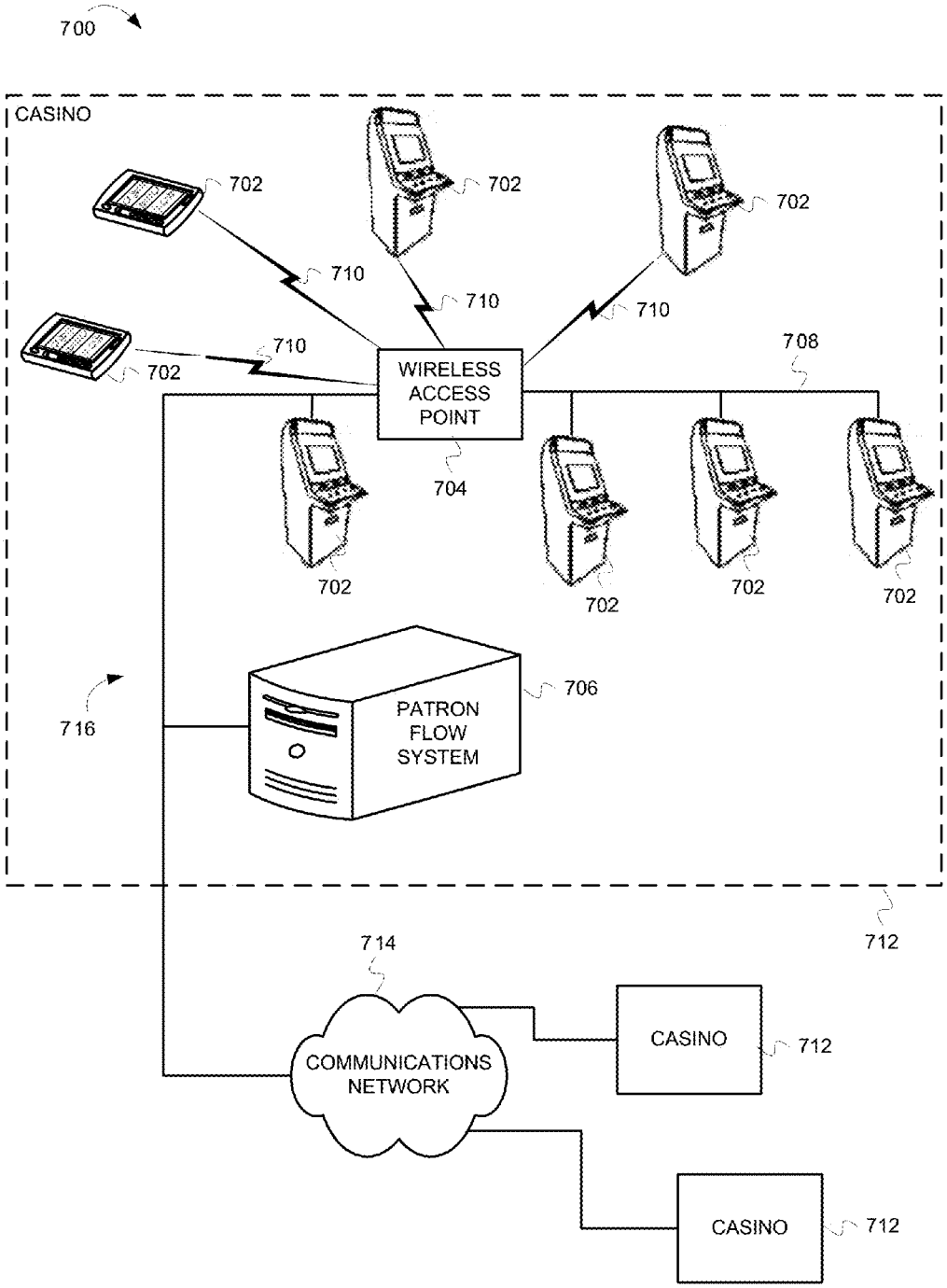
FIG. 7 is a block diagram illustrating a wagering game network 700, according to example embodiments of the invention.

FIG. 7 is a block diagram illustrating a wagering game network 700, according to example embodiments of the invention. As shown in FIG. 7, the wagering game network 700 includes a plurality of casinos 712 connected to a communications network 714.

Each casino 712 includes a local area network 716, which includes an access point 704, a patron flow system 706, and wagering game machines 702. The access point 704 provides wireless communication links 710 and wired communication links 708. The wired and wireless communication links can employ any suitable connection technology, such as Bluetooth, 802.11, Ethernet, public switched telephone networks, SONET, etc. The patron flow system 706 embodies functionality for determining patron flow based on data collected, at least, from the wagering game network 700. In some embodiments, the patron flow system 706 can embody wagering game server functionality to serve wagering games and distribute content to devices located in other casinos 712 or at other locations on the communications network 714. In some embodiments, a back-end server embodies a patron flow unit that performs at least some of the functionality described herein for determining patron flow in a wagering game establishment.

The wagering game machines 702 described herein can take any suitable form, such as floor standing models, handheld mobile units, bartop models, workstation-type console models, etc. Further, the wagering game machines 702 can be primarily dedicated for use in conducting wagering games, or can include non-dedicated devices, such as mobile phones, personal digital assistants, personal computers, etc. In one embodiment, the wagering game network 700 can include other network devices, such as accounting servers, wide area progressive servers, player tracking servers, and/or other devices suitable for use in connection with embodiments of the invention.

In some embodiments, wagering game machines 702 and the patron flow system 706 work together such that a wagering game machine 702 can be operated as a thin, thick, or intermediate client. For example, one or more elements of game play may be controlled by the wagering game machine 702 (client) or the patron flow system 706 (server). Game play elements can include executable game code, lookup tables, configuration files, game outcome, audio or visual representations of the game, game assets or the like. In a thin-client example, the patron flow system 706 can perform functions such as determining game outcome or managing assets, while the wagering game machine 702 can present a graphical representation of such outcome or asset modification to the user (e.g., player). In a thick-client example, the wagering game machines 702 can determine game outcomes and communicate the outcomes to the patron flow system 706 for recording or managing a player's account.

In some embodiments, either the wagering game machines 702 (client) or the patron flow system 706 can provide functionality that is not directly related to game play. For example, account transactions and account rules may be managed centrally (e.g., by the patron flow system 706) or locally (e.g., by the wagering game machine 702). Other functionality not directly related to game play may include power management, presentation of advertising, software or firmware updates, system quality or security checks, etc.

Any of the wagering game network components (e.g., the wagering game machines 702) can include hardware and machine-readable media including instructions for performing the operations described herein.

Embodiments may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, embodiments of the inventive subject matter may take the form of a computer program product embodied in any tangible medium of expression having computer usable program code embodied in the medium. The described embodiments may be provided as a computer program product, or software, that may include a machine-readable medium having stored thereon instructions, which may be used to program a computer system (or other electronic device(s)) to perform a process according to embodiments, whether presently described or not, since every conceivable variation is not enumerated herein. A machine readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions. In addition, embodiments may be embodied in an electrical, optical, acoustical or other form of propagated signal (e.g., carrier waves, infrared signals, digital signals, etc.), or wireline, wireless, or other communications medium.

GENERAL

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. For instance, examples refer to flow within a wagering game establishment, but patron flow data can also be generated for visualization of flow among different wagering game establishments. Each of the embodiments described herein are contemplated as falling within the inventive subject matter, which is set forth in the following claims.

The invention claimed is:

1. A method of operating a gaming system, the method comprising:

receiving, via a network communication interface of the gaming system, wagering game data from a plurality of wagering game machines in a wagering game establishment, wherein the plurality of wagering game machines include value input devices configured to receive monetary value for placement of one or more wagers on casino wagering games, and wherein the wagering game data is generated by the plurality of wagering game machines after use of the value input devices;

aggregating, via at least one server, the wagering game data from the plurality of wagering game machines, wherein aggregated wagering game data is associated with patrons of the wagering game establishment;

determining, based on the aggregated wagering game data, that locations of the patrons coincide with locations of physical items in the wagering game establishment within a given time period;

determining, via the at least one server, one or more events in the wagering game establishment that influenced the patrons to move to the locations of the physical items;

electronically indicating, by an electronic display device, a-graphical representations of the events and the locations of the patrons in relation to graphical representations of the physical items.

2. The method of claim 1 further comprising determining, based on the aggregated wagering game data, that activities of the patrons meet a threshold criterion within the given time period.

3. The method of claim 2, wherein the determining that the activities of the patrons meets the threshold criterion comprises:

determining that the patrons input a minimum amount of monetary value into the wagering game machines within the given time period; and wherein the determining that the locations of the patrons coincide with the locations of the physical items comprises determining movement of the patrons to the wagering game machines into which the minimum amount of monetary value was input.

4. The method of claim 2, wherein the determining that activities of the patrons meets the threshold criterion comprises:

determining that the patrons made purchases at specific areas within the wagering game establishment, and wherein the determining that the locations of the patrons coincide with the locations of the physical items comprises determining movement of the patrons in proximity to where the purchases were made.

5. The method of claim 2, wherein the determining that the patrons meet the threshold criterion comprises determining that the patrons have won at least a specified amount of winnings within the specific time period, and further comprising providing one or more invitations to the patrons to perform an activity, and wherein the locations of the physical items in the wagering game establishment correspond to physical items at one or more geographic areas associated with the activity.

6. The method of claim 2, wherein the determining that the patrons meet the threshold criterion includes determining that the patrons have invited a specific number of the patrons to participate in a social activity within the wagering game establishment, wherein the method further comprises:

determining a social group separate from the patrons, and wherein the determining that the locations of the patrons coincide with the locations of the physical items includes determining locations of members of the social group.

7. The method of claim 2 further comprising:

evaluating demographic data of the subset of the patrons against social group constraints; and determining that the demographic data of the patrons comports with the social group constraints based, at least in part, on the evaluating.

8. A non-transitory machine-readable storage medium having instructions stored thereon which, when executed by a set of one or more processors of a gaming system, cause the set of one or more processors to perform operations for controlling a wagering game system, the instructions comprising:

instructions to receive, via a network communication interface of the gaming system, wagering game data from a plurality of wagering game machines in a wagering game establishment, wherein the plurality of wagering game machines include value input devices configured to receive monetary value for placement of one or more wagers on casino wagering games, and wherein the wagering game data is generated by the plurality of wagering game machines after use of the value input devices;

instructions to aggregate, by a server, the wagering game data from the plurality of wagering game machines, wherein aggregated wagering game data is associated with patrons of the wagering game establishment;

instructions to determine, by the server, that locations of the patrons coincide with locations of physical items in the wagering game establishment within the given time period;

instructions to determine, by the server, movements of the patrons about the wagering game establishment based on the locations of the patrons;

instructions to determine, by the server, a candidate social group for a subset of the patrons based at least in part on the movements of the patrons;

instructions to electronically notify the subset of the patrons about the candidate social group;

instructions to electronically indicate, by an electronic display device, a graphical representation of the locations of the subset of the patrons in relation to graphical representations of the physical items.

9. The non-transitory machine-readable storage medium of claim 8, further comprising:

instructions to determine that activities of the patrons meet a threshold criteria.

10. The non-transitory machine-readable storage medium of claim 9, wherein the instructions to determine that the activities of the patrons meet the threshold criteria includes instructions to determine that the patrons made purchases at specific areas within the wagering game establishment, and wherein the instructions to determine that the locations of the patrons coincide with the locations of the physical items include instructions to determine movement of the patrons to where the purchases were made.

11. The non-transitory machine-readable storage medium of claim 9, wherein the instructions to determine that the patrons meet the threshold includes instructions to determine that the patrons have won above a given amount of winnings within the specific time period, and said instructions further comprising instructions to provide one or more invitations to the patrons to perform an activity, and wherein the locations of the physical items in the wagering game establishment correspond to one or more geographic areas associated with the activity.

12. The non-transitory machine-readable storage medium of claim 9, wherein the instructions to determine that activities of the patrons meet the threshold criteria include instructions to determine that the patrons have invited a specific number of the patrons to participate in a social activity within the wagering game establishment, and instructions further including instructions to determine a social group separate from the subset of the patrons, and wherein the instructions to determine that the locations of the patrons coincide with the locations of the physical items includes instructions to determine locations of members of the social group.

13. The non-transitory machine-readable storage medium of claim 9, said instructions further comprising:

instructions to evaluate demographic data of the patrons against social group constraints; and instructions to determine that the demographic data of the patrons comports with the social group constraints based, at least in part, on the evaluation of the demographic data.

14. A gaming apparatus comprising:

a network communication interface;

an electronic display device;

one or more electronic processing units; and a memory storage device configured to store instructions which, when executed by at least one of the one or more electronic processing units, for controlling the gaming apparatus, the instructions including instructions to:

receive, via the network communication interface, wagering game data from a plurality of wagering game machines in a wagering game establishment, wherein the plurality of wagering game machines include value input devices configured to receive monetary value for placement of one or more wagers on casino wagering games, and wherein the wagering game data is generated by the plurality of wagering game machines after use of the value input devices, aggregate the wagering game data from the plurality of wagering game machines, wherein aggregated wagering game data is associated with patrons of the wagering game establishment, determine that locations of the patrons coincide with locations of physical items in the wagering game establishment, determine movements of the patrons about the wagering game establishment based on the locations of the location of the patrons;

determine a candidate social group for a subset of the patrons based on the movements of the patrons;

electronically notify the patrons about the candidate social group;

electronically indicate, by the electronic display device, a graphical representation of the locations of the patrons in relation to graphical representations of the physical items.

15. The gaming apparatus of claim 14, wherein the instructions are further to determine that activities of the patrons meet a threshold criteria.

16. The gaming apparatus of claim 15, wherein the instructions to determine that activities of the patrons meet a threshold criteria include instructions to determine that the patrons make purchases at specific areas within the wagering game establishment.

17. The gaming apparatus of claim 14, wherein the instructions are further to determine that the patrons have won above a given amount of winnings within a specific time period, and provide one or more invitations to the patrons to perform an additional activity.

18. The gaming apparatus of claim 14 wherein the instructions are further to:

determine that the patrons have invited a specific number of the patrons to participate in a social activity within the wagering game establishment, select a social group separate from the subset of the patrons, and determine locations of members of the social group.

19. The gaming apparatus of claim 14, the instructions further to:

evaluate demographic data of the patrons against social group constraints; and determine that the demographic data of the patrons comports with the social group constraints based, at least in part, on evaluation of the demographic data.

* * * * *